US005946868A

United States Patent [19]

Morris

[11] Patent Number: 5,946,868

[45] **Date of Patent: *Sep. 7, 1999**

[54] ADJUSTABLE AIR DEFLECTOR FOR A ROOF VENTILATOR

[75] Inventor: Richard J. Morris, Prior Lake, Minn.

[73] Assignee: Liberty Diversified Industries, New Hope, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/127,005

[22] Filed: Sep. 24, 1993

[51] Int. Cl.[6] ..... F04F 7/02

[52] U.S. Cl. ..... 52/199; 52/58; 52/302.3; 454/365; 454/367

[58] Field of Search ..... 52/198, 199, 58, 52/302.1, 302.3, 302.6; 454/365, 366, 367

[56] References Cited

U.S. PATENT DOCUMENTS

| | | | |
|---|---|---|---|
| Re. 27,943 | 3/1974 | Smith | 98/42 |
| 3,079,853 | 3/1963 | Smith | 98/42 |
| 3,185,070 | 5/1965 | Smith | 454/365 |
| 3,311,047 | 3/1967 | Smith et al. | 98/42 |
| 3,326,113 | 6/1967 | Smith et al. | 454/365 |
| 3,625,134 | 12/1971 | Smith | 98/42 |
| 4,280,399 | 7/1981 | Cunning | 98/42 A |
| 4,325,290 | 4/1982 | Wolfert | 98/42 A |
| 4,554,862 | 11/1985 | Wolfert | 98/42.21 |
| 4,643,080 | 2/1987 | Trostle et al. | 98/42.21 |
| 4,803,813 | 2/1989 | Fiterman . | |
| 5,022,314 | 6/1991 | Waggoner | 454/365 X |
| 5,094,041 | 3/1992 | Kasner et al. . | |
| 5,095,810 | 3/1992 | Robinson | 454/365 |
| 5,122,095 | 6/1992 | Wolfert | 454/365 |
| 5,149,301 | 9/1992 | Gates | 454/365 |
| 5,288,269 | 2/1994 | Hansen | 454/365 |

*Primary Examiner*—Carl D. Friedman
*Assistant Examiner*—Timothy B. Kang
*Attorney, Agent, or Firm*—Patterson & Keough, P.A.

[57] ABSTRACT

An air deflector for installation with a roof ventilator having a pair of vent parts defining a multiplicity of air passages, the air deflector comprising a base member and a generally upright air flow blocking member extending upwardly from the base member at a generally acute angle of 75°. Two air deflectors extend along the entire length of the roof ventilator proximate to the outer edge of each opposing vent part. The base member is disposed between the bottom surface of the corresponding vent part, and the upright air flow blocking member confronts and is spaced apart a selected distance from the outer edge of the vent part and angles inwardly slightly toward the vent part. The top edge of the upright air flow blocking member angles slightly outward away from the vent part, and is disposed at approximately the same height as the top panel of the roof ventilator. The base member includes end notches designed and positioned to facilitate installation and retrofitting of the air deflector with a wide variety of existing roof ventilator configurations, and spacing of the upright air flow blocking member at desired distances from the outer edge of the vent part.

9 Claims, 2 Drawing Sheets

ADJUSTABLE AIR DEFLECTOR FOR A ROOF VENTILATOR

BACKGROUND OF THE INVENTION

This invention relates generally to roof ventilators, and particularly to an air deflector for impeding the flow of wind or blowing air through the multiplicity of air passages from the exterior of the roof ventilator and diverting the flow of blowing air over the top panel of the roof ventilator.

Embodiments of a foldable corrugated plastic ridge cap roof ventilator have previously been disclosed in U.S. Pat. Nos. 4,803,813 to Fiterman and 5,094,041 to Kasner, the content of those patents (including the related applications, documents, and references) being incorporated herein by reference as though fully set forth. The details and description of the fabrication, assembly, and use of the roof ventilators shown in the Fiterman '813 and Kasner '041 patents should be assumed to apply in all pertinent respects to the roof ventilator discussed herein, with the exception of the particular variations and modifications set forth and described with particularity. The improvement disclosed herein is equally applicable to and may be incorporated into many other types of ridge cap type roof ventilators.

Because the exposed outer edges of the vent parts are raised above the normal plane of the shingles or other roofing material and present a blunt edge or surface, and the roof ventilator is further covered with shingles or roofing materials that may overhang the outer edges of the vent parts, it is important to protect the roof ventilator and roofing materials from high winds that can carry particulate matter and foreign objects from the exterior of the roof ventilator through the multiplicity of air passages into the interior of the roof ventilator, interfere with the normal venting process by preventing convective forces from drawing air out through the air passages, and which may lift or tear the roof ventilator and surrounding roofing materials from the roof and thereby cause extensive damage.

There is currently a difference of opinions among those in the field of installing such roof ventilators regarding the optimum distance that an air flow blocking member should be spaced apart from the outer edge of the corresponding vent part. The range of preferred distances includes mounting the air flow blocking member closely proximate to or in contact with the outer surface of the vent part, or away from the outer edge of the vent part by up a to few inches.

U.S. Pat. No. 4,843,953 to Sells discloses a roof ventilator having a flashing strip which is an inverted V-shaped or acutely-angled perforated metal cover for the outer edges of the vent parts. One leg of the flashing strip is inserted between the top panel and the vent part, with the other leg depending substantially flush with the outer edge of the vent part in covering relation to the air passages. The Sells '953 device is intended to mitigate against the introduction of foreign objects and insects into the air passages, and may retard or reduce the volume or rate of air flowing from the exterior of the roof ventilator through the air passages, but will not protect the roof ventilator or roofing material from being lifted or torn by high winds.

Air Vent, Inc. of Peoria Heights, Illinois manufactures a roof ventilator having a unitary air flow guard with a base member that is inserted between the stacked panels of the vent part and are fixedly attached to the vent part. An air flow blocking member extends from the base member at a right angle and is spaced a predetermined fixed distance from the outer edge of the vent part. That distance is normally on the order of ½"–¾", but the unitary roof vent and air flow guard may also be fabricated so that the air flow guard is fixed substantially flush with the outer edge of the vent part or alternately spaced a greater distance away. The air flow guard impedes the direct flow of wind blowing through the air passages from the exterior of the roof ventilator and diverts a portion of the air flow across the top of the roof ventilator.

BRIEF SUMMARY OF THE INVENTION

It is therefore one object of this invention to design an improved air deflector which substantially reduces the flow of wind and airborne matter through the multiplicity of air passages from the exterior of the roof ventilator and diverts the flow of wind over the top panel of the roof ventilator.

It is a related object of this invention to design the above air deflector such that it will remain effective for its intended purpose at extremely high wind levels on the order of 85–100 m.p.h. or hurricane velocity accompanied by rain falling at a rate of up to 8.8" per hour.

It is a distinct object of this invention to design the above air deflector such that it can be installed simultaneously with a conventional roof ventilator in any one of several selected configurations, and may be retrofitted to a variety of existing and previously installed roof ventilators in one of several selected configurations.

Briefly described, the air deflector of this invention comprises a base member and a generally upright air flow blocking member extending upwardly from the base member at a generally acute angle of 75°. Two air deflectors extend along the entire length of the roof ventilator proximate to the outer edge of each opposing vent part. The base member is disposed between the bottom surface of the corresponding vent part, and the upright air flow blocking member confronts and is spaced apart a selected distance from the outer edge of the vent part and angles inwardly slightly toward the vent part. The top edge of the upright air flow blocking member angles slightly outward away from the vent part, and is disposed at approximately the same height as the top panel of the roof ventilator. The base member includes end notches designed and positioned to facilitate installation and retrofitting of the air deflector with a wide variety of existing roof ventilator configurations, and spacing of the upright air flow blocking member at desired distances from the outer edge of the vent part.

DESCRIPTION OF THE PREFERRED EMBODIMENTS

Figure 1:
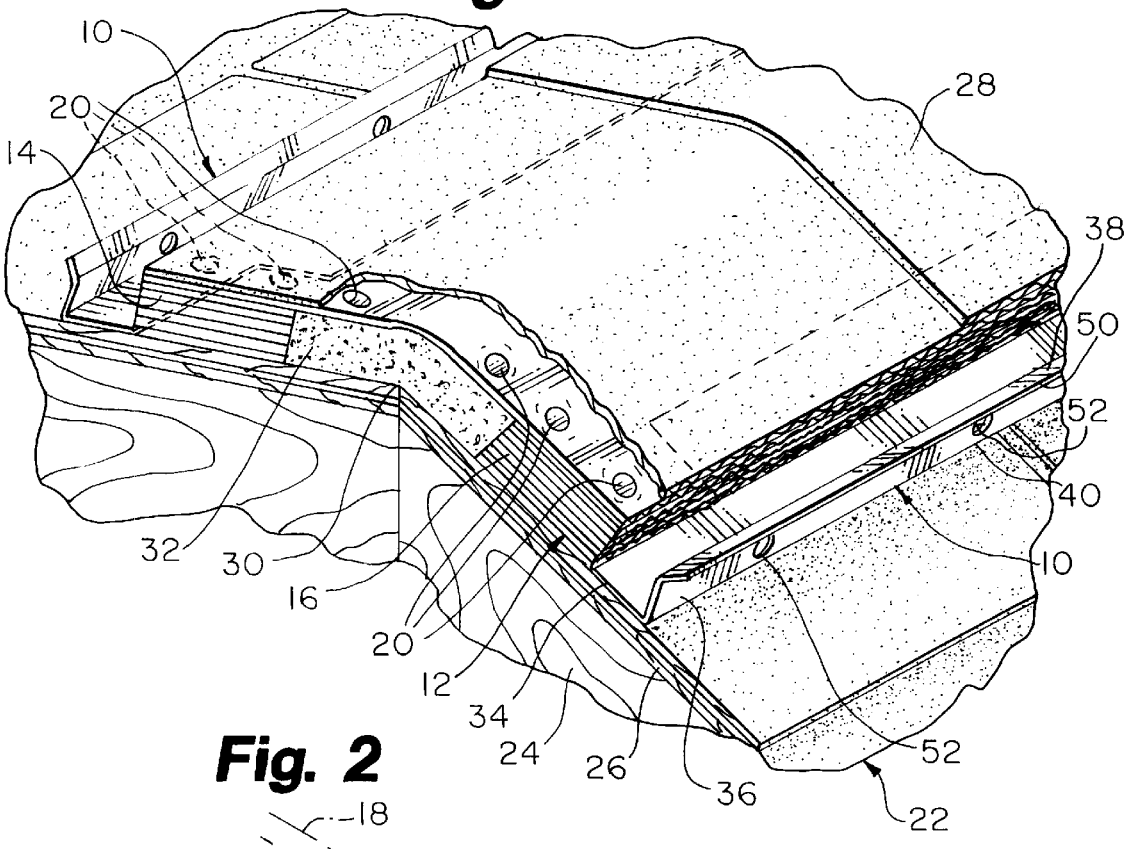
FIG. 1 is a perspective view of a roof ventilator installed on a roof with the air deflector of this invention installed in the intermediate configuration.

The air deflector or baffle of this invention is shown in FIGS. 1–5 and referenced generally therein by the numeral 10.

The foldable corrugated plastic roof ventilators as disclosed in U.S. Pat. Nos. 4,803,813 to Fiterman and 5,094,041 to Kasner are basic to the design of the air deflector 10, and the terminology utilized in those patents is generally adopted herein.

The roof ventilator 12 comprises a pair of ventilator sections 14, 16 and a top panel 18 secured in position by nails or similar fasteners 20 in position disposed over an open cutout in the roof 22. The roof 22 is generally comprised of a plurality of angled joists, trestles, and beams 24 covered with overlays of plywood 26 and shingles 28, respectively, and together form a central peak or ridge 30.

The roof ventilator 12 may be of any type such as shown in the Fiterman '813 or Kasner '041 patents, the related patent references discussed above, or the design disclosed and discussed in the co-pending U.S. patent application entitled Roof Ventilator Having Longitudinally Aligned Folding Sections filed on even date herewith Sept. 24, 1993, and granted Ser. No. 08/126,371, now U.S. Pat. No. 5,304,095 to Morris. In addition, the roof ventilator 12 may include one or more foam end closures 32 or intermediate supports of the type disclosed and discussed in the co-pending U.S. patent application entitled End Closure Or Intermediate Support For A Roof Ventilator And Method Of Making Same filed on even date herewith Sept. 24, 1993, and granted Ser. No. 08/126,307.

The air deflector 10 is fabricated from approximately 26 gauge sheet aluminum that is stamped and folded to form the configuration shown in FIGS. 1–5. The air deflector 10 includes a base member 34, an upwardly extending leg member 36 which serves as an air flow blocking member, and an outwardly extending lip member 38. The leg member 36 extends from and is connected to and along the front edge 40 of the base member 34, and the lip member 38 extends from and is connected to and along the top edge 42 of the leg member 36.

The base member 34 further has a rear edge 44 and a pair of opposing end edges 46, 48. The length of the air deflector 10 is preferably 48" measured between the pair of opposing end edges 46, 48. The width of the air deflector 10 is preferably 2.625" measured between the rear edge 44 and the front edge 40 of the base member 34. The height of the leg member 36 is preferably 0.675" measured the front edge 40 of the base member 34 to and along the top edge 42 of the leg member 36, and the height of the lip member 38 is preferably 0.25" measured from the top edge 42 of the leg member 36 to the top edge 50 of the lip member 38. The leg member 36 preferably forms a substantially acute angle of 75° relative to the plane of the base member 34, and the lip member 38 preferably forms a substantially obtuse angle of 135° relative to the plane of the base member 34.

As such, the air deflector preferably has a length generally equal to the length of the corresponding vent part 14, 16, and a overall height approximately equal to the height of the vent parts 14, 16 measured between the shingles 28 and the top surface of the top panel 18.

Figure 4:
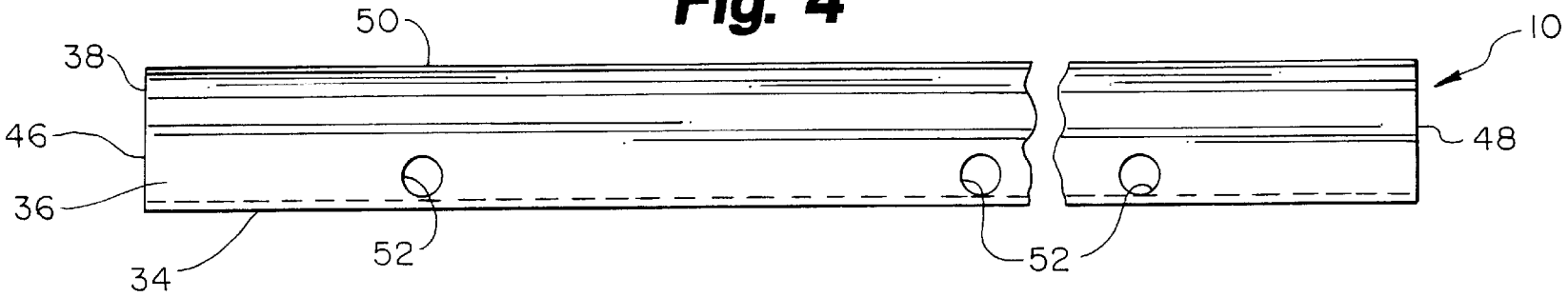
FIG. 4 is a front elevation view of the air deflector of FIG. 1.

Referring particularly to FIG. 4, the leg member 36 defines a plurality of circular apertures 52 extending completely through the leg member 36. Two of the plurality of apertures 52 are each spaced approximately 2" from a corresponding one of the end edges 46, 48 of the air deflector 10, with the remainder of the apertures 52 spaced apart at 4" intervals from one another along the length of the air deflector 10.

Figure 5:
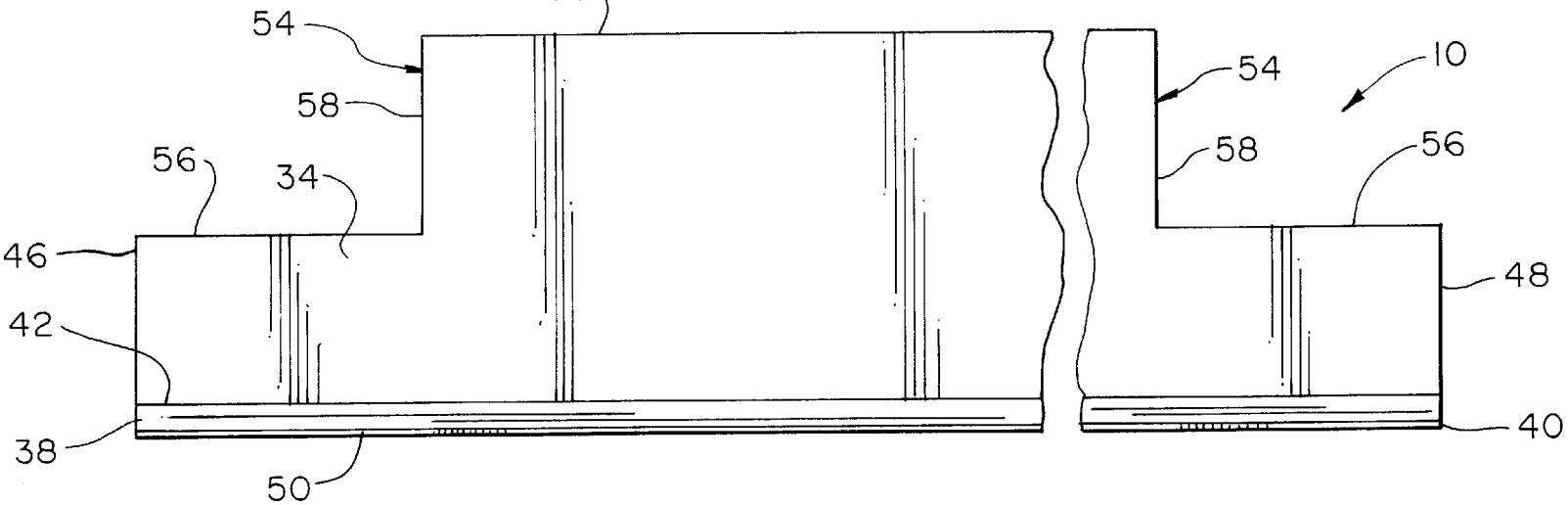
FIG. 5 is a top plan view of the air deflector of FIG. 1.

Referring particularly to FIG. 5, the base member 34 defines a pair of generally rectangular locator notches 54 that extend into the base member 34 approximately 2" from the corresponding end edges 46, 48 and 1.375" from the rear edge 44.

In operation, the air deflectors 10 may be installed at the same time that the roof ventilators 12 are being installed, or may be retrofitted to an existing installed line of roof ventilators 12.

A roof ventilator 12 is normally placed in a predetermine location on the roof 22 covering the opening, with the top panel 18 bent or flexed across the centerline so that its vent parts 14, 16 are in contact with the shingles 28 covering the roof 22 on disposed the opposing sides of the opening and peak 30. The roof ventilators 12 are also covered by an overlapping layer of pre-folded shingles 28. Each roof ventilator 12 and the corresponding overlaid shingles 28 are secured in position by galvanized roofing nails or similar fasteners 20 that are driven through the shingle 28, top panel 18, vent part 14, 16, and into the roof 22. Conversely, the roof ventilators 12 may be secured in position using the fasteners 20, and then the overlapping layer of shingles 28 attached to the roof ventilators 12 using fasteners 20.

An air deflector 10 may be installed on each side of each roof ventilator 12 parallel with and along the exterior edge of each vent part 14, 16 as shown in FIG. 1, either concurrently with installation of the roof ventilators 12 or retrofitted to existing roof ventilators 12.

Figure 2:
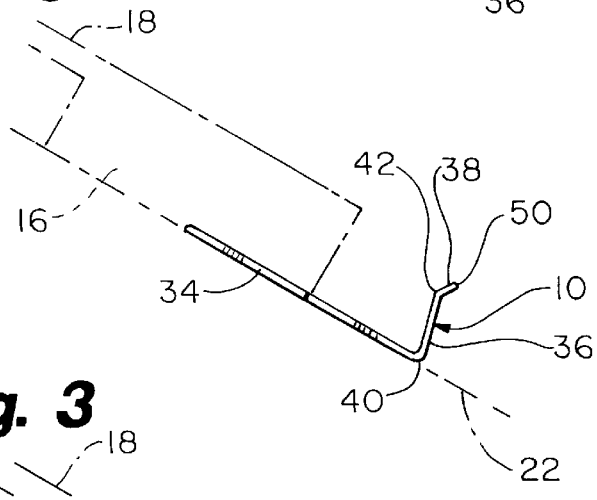
FIG. 2 is a diagrammatic side elevation view of the top panel and one vent part of the roof ventilator of FIG. 1 showing the air deflector of FIG. 1 installed in an extended configuration.
Figure 3:
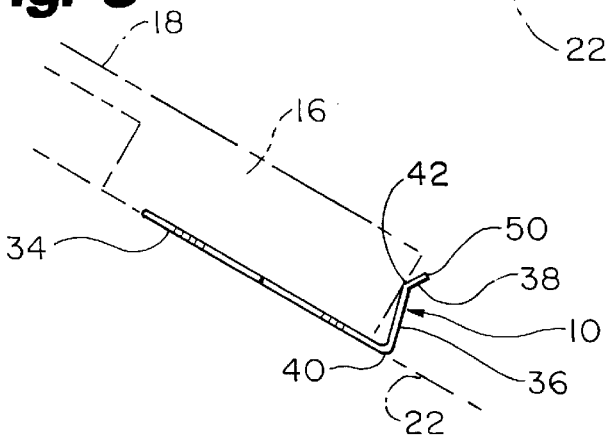
FIG. 3 is an diagrammatic side elevation view of the top panel and one vent part of the roof ventilator of FIG. 1 showing the air deflector of FIG. 1 installed in an retracted configuration.

Referring to FIGS. 2 and 3, it may be appreciated by those skilled in the art that the base member 34 of each air deflector 10 may be slidably inserted beneath the bottom panel of the corresponding vent part 14, 16, and above or on top of the top surface of the layer of shingles 28 covering the roof 22 surrounding the opening. The base member 34 of the air deflector 10 may be inserted beneath the vent part 14, 16 until the leg member 36 is disposed a selected and preferred distance away from the exterior edge of the corresponding vent part 14, 16, anywhere between a maximally separated position as shown in FIG. 2 and a minimally separated or contacting position as shown in FIG. 3 or an intermediate position therebetween.

It may further be appreciated that the rear edges 56 of the locator notches 54 serve as guides for positioning and aligning the air deflectors 10 parallel with the exterior edges of the vent parts 14, 16 and with the leg members 36 at a predetermined distance, with the rear edges 56 butting against the fasteners 20 that have previously been driven through the roof ventilator 12 at predetermined locations parallel with the exterior edges of the vent parts 14, 16. The side edges 58 of the locator notches 54 can additionally be used to position and align the air deflector 10 with the lengthwise ends of the roof ventilator.

In retrofitting the air deflectors 10 to existing roof ventilators 12, the portion of the base member 34 adjacent to the locator notches 54 may be cut away using tin snips, a saw, or a scribing tool, and may be cut uniformly according to a predesignated pattern to provide for consistent installation according to a predefined scheme. Alternately, when installing the air deflectors 10 along with the roof ventilators 12, a standardized gauge (not shown) having a thickness equal to the desired displacement between the exterior edge of the corresponding vent part 14, 16 and the top edge 42 of the leg member 36 can be inserted between the leg member 36 and the vent part 14, 16, and the air deflector 10 pushed inwardly toward the vent part 14, 16 until further movement is obstructed by the gauge. The roof ventilator 12 and air deflector 10 may then be secured to the roof 22 using the fasteners 20, and then covered by pre-folded shingles 28 as described above.

The air deflector 10 may also be fixedly attached to the vent parts 12 of the roof ventilator 12 prior to installation using staples, adhesive, or any other conventional fastening means.

It may also be appreciated that the base member 34 of the air deflector 10 may be inserted between intermediate panels of the vent parts 14, 16 rather than beneath the bottom panel, particularly where the vent parts 14, 16 are constructed from a blank of corrugated plastic sheet material fabricated using the nick- or cut-scored processes described in the Fiterman '813 and Kasner '041 patents. In such a case, for purposes of defining the base member 34 of the air deflector 10 being positioned or disposed beneath the vent part shall also mean beneath the top panel 18 and one or more of the panels of the vent parts 14, 16, but not necessarily beneath the bottom or lowermost panel thereof.

While the preferred embodiment of the above air deflector has been described in detail above with reference to the attached drawing Figures, it is understood that various changes and adaptations may be made in the air deflector 10 or air deflector 10 without departing from the spirit and scope of the appended claims.

What is claimed is:

1. A roof ventilator system mounted on a peak of a roof, said system comprising an air deflector and a roof ventilator, wherein said roof ventilator comprises:

a top panel, a vent part, an interior region, and an exterior region, said vent part defining a multiplicity of air passages communicating with said interior region and said exterior region, said vent part having an exterior edge intersecting said multiplicity of air passages, said vent part having a height measured from said roof to said top panel, said roof ventilator having a length, wherein said air deflector comprises:

a base member including a rear edge and a pair of end edges, the base member defining at least one locator notch extending inwardly from the rear edge of the base member and at least one of the pair of end edges of the base member, said base member being disposed generally beneath at least a portion of a vent part and above the roof; and a leg member, said leg member extending generally upward from and connected to said base member such that said leg member is generally parallel with and spaced a distance apart from the exterior edge of the vent part, said leg member having a length generally equal to the length of the roof ventilator and a height generally equal to the height of the vent part, said leg member being disposed said distance from the exterior edge of the vent part and secured at said distance so as to impede the flow of blowing air through the multiplicity of air passages from the exterior region of the roof ventilator and to divert the flow of blowing air over the top panel of the roof ventilator, said distance being selected from a plurality of varying distances and adjustable between said plurality of varying distances from a maximal distance to a minimal distance prior to the installation of the air deflector on the roof, whereby the leg member is initially disposed and spaced apart the distance from the exterior edge of the vent part and is freely adjustable between the plurality of varying distances by sliding the air deflector such that the leg member moves toward or away from the exterior edge of the vent part, the air deflector only being secured with the leg member at the selected distance from the exterior edge of the vent part once the roof ventilator is installed on and fastened to the roof.

2. The roof ventilation system of claim 1, further comprising:

a lip member, said lip member extending from and connected to the leg member, said lip member forming a generally obtuse angle with the leg member.

3. The roof ventilator system of claim 2, wherein the generally obtuse angle is approximately equal to 135°.

4. The roof ventilation system of claim 1, wherein the at least one locator notch is generally rectangular.

5. The roof ventilation system of claim 1, wherein the at least one locator notch comprises a first locator notch and a second locator notch, and wherein said a first locator notch is disposed adjacent to a first one of the pair of end edges and said second locator notch is disposed adjacent to a second one of the pair of end edges.

6. The roof ventilation system of claim 5, wherein the first locator notch and the second locator notch each have a depth measured from the rear edge of the base member, the depth of the first locator notch being approximately equal to the depth of the second locator notch.

7. The roof ventilation system of claim 6, wherein the roof ventilator is secured to the roof using a plurality of fasteners which extend through the roof ventilator and into the roof, and wherein the first locator notch and the second locator notch each have a rear edge, the depth of the first locator notch and the depth of the second locator notch being such that when the rear edge of the first locator notch and the rear edge of the second locator notch each contact a one of the plurality of fasteners, the leg member of the air deflector will be positioned and aligned generally parallel with the exterior edge of the vent part and displaced the selected distance from the exterior edge of the vent part.

8. The roof ventilator system of claim 1, wherein said leg member extends upwardly from said base member at a generally acute angle substantially less than 90°.

9. The roof ventilator system of claim 8, wherein the generally acute angle formed between the base member and the leg member is approximately equal to 75°.

* * * * *